US007721437B2

(12) United States Patent
Howell et al.

(10) Patent No.: US 7,721,437 B2
(45) Date of Patent: May 25, 2010

(54) METHODS FOR ASSEMBLING GAS TURBINE ENGINE COMBUSTORS

(75) Inventors: Stephen John Howell, West Newbury, MA (US); John Carl Jacobson, Melrose, MA (US); Timothy P. McCaffrey, Swampscott, MA (US); Barry Francis Barnes, Malden, MA (US)

(73) Assignee: General Electric Company, Schenectady, NY (US)

( * ) Notice: Subject to any disclaimer, the term of this patent is extended or adjusted under 35 U.S.C. 154(b) by 211 days.

(21) Appl. No.: 11/951,765

(22) Filed: Dec. 6, 2007

(65) Prior Publication Data

US 2008/0209728 A1 Sep. 4, 2008

Related U.S. Application Data

(62) Division of application No. 10/688,754, filed on Oct. 17, 2003, now Pat. No. 7,310,952.

(51) Int. Cl.
*B21K 25/00* (2006.01)

(52) U.S. Cl. ..... 29/889.22; 29/889.2; 60/748

(58) Field of Classification Search ..... 29/889.2, 29/889.22; 60/748

See application file for complete search history.

(56) References Cited

U.S. PATENT DOCUMENTS

| | | | | |
|---|---|---|---|---|
| 4,950,129 | A | 8/1990 | Patel et al. | |
| 5,222,360 | A | 6/1993 | Antuna et al. | |
| 5,228,828 | A | 7/1993 | Damlis et al. | |
| 5,273,396 | A | 12/1993 | Albrecht et al. | |
| 5,281,085 | A | 1/1994 | Lenahan et al. | |
| 5,820,024 | A | 10/1998 | Ausdenmoore et al. | |
| 5,991,679 | A | 11/1999 | Sigg | |
| 6,045,325 | A | 4/2000 | Horvath et al. | |
| 6,314,739 | B1 * | 11/2001 | Howell et al. | 60/748 |
| 6,955,038 | B2 | 10/2005 | McCaffrey et al. | |
| 7,093,419 | B2 | 8/2006 | McCaffrey et al. | |
| 7,114,914 | B2 | 10/2006 | Gendraud et al. | |

* cited by examiner

*Primary Examiner*—Rick K Chang
(74) *Attorney, Agent, or Firm*—William Scott Andes, Esq.; Armstrong Teasdale LLP

(57) ABSTRACT

A method facilitates assembling a combustor for a gas turbine engine, wherein the combustor includes a swirler assembly. The method comprises machining material to form a domeplate, positioning a sealplate including an overhanging portion against the domeplate, securing the sealplate in position relative to the domeplate with a welding process, and welding the swirler assembly to the domeplate.

11 Claims, 4 Drawing Sheets

METHODS FOR ASSEMBLING GAS TURBINE ENGINE COMBUSTORS

CROSS-REFERENCE TO RELATED APPLICATIONS

This application is a divisional of U.S. patent application Ser. No. 10/688,754, filed Oct. 17, 2003, now U.S. Pat. No. 7,310,952 which is hereby incorporated by reference and is assigned to assignee of the present invention.

STATEMENT REGARDING FEDERALLY SPONSORED RESEARCH OR DEVELOPMENT

The U.S. Government may have certain rights in this invention pursuant to contract number DAAE07-00-C-N086.

BACKGROUND OF THE INVENTION

This invention relates generally to gas turbine engines, more particularly to combustors used with gas turbine engines.

Known turbine engines include a compressor for compressing air which is suitably mixed with a fuel and channeled to a combustor wherein the mixture is ignited within a combustion chamber for generating hot combustion gases. More specifically, at least some known combustors include a dome assembly that channels airflow downstream and circumferentially around each fuel injector. More specifically, at least some known dome assemblies include a swirler assembly that extends upstream from a domeplate, and a baffle that extends downstream from the domeplate and into the combustion chamber.

Within recuperated gas turbine engines, combustor inlet temperatures may be elevated in comparison to other non-recuperated gas turbine engines, and as such, at least some dome assembly components within such engines, may be exposed to higher temperatures than other known gas turbine engine dome assemblies. As such, to facilitate withstanding exposure to the high temperatures generated within the combustion chamber, at least some known baffles are fabricated from a super alloy, such as, but not limited to Rene N5®. Although such materials are resistant to the high temperatures, such materials may be limited in their means of being coupled to the domeplate. Accordingly, known combustors including components fabricated from such super alloys are typically coupled together with an extensive brazing process. Although the brazing process is generally reliable, such processes may also be time-consuming and expensive.

BRIEF DESCRIPTION OF THE INVENTION

In one aspect, a method for assembling a combustor for a gas turbine engine is provided. The combustor includes a swirler assembly. The method comprises machining material to form a domeplate, positioning a sealplate including an overhanging portion against the domeplate, securing the sealplate in position relative to the domeplate with a welding process, and welding the swirler assembly to the domeplate.

In another aspect, a combustor for a gas turbine engine is provided. The combustor includes a swirler assembly and a dome assembly. The dome assembly includes a sealplate and a domeplate. The sealplate is welded to the domeplate and includes an overhang portion and an integrally-formed body. More specifically, the sealplate is welded to the domeplate such that a gap is defined between the domeplate and the sealplate overhang portion. The swirler assembly is welded to the domeplate.

In a further aspect, a gas turbine engine including a combustor is provided. The combustor includes a dome assembly, at least one injector, and an air swirler. The dome assembly includes a sealplate and a domeplate. The sealplate is welded to the domeplate and comprising a body and an overhang portion that extends integrally from the body. The sealplate is welded to the domeplate such that a gap is defined between the domeplate and the sealplate overhang portion. The swirler assembly is welded to the domeplate. The at least one injector is coupled to the dome assembly.

DETAILED DESCRIPTION OF THE INVENTION

Figure 1:
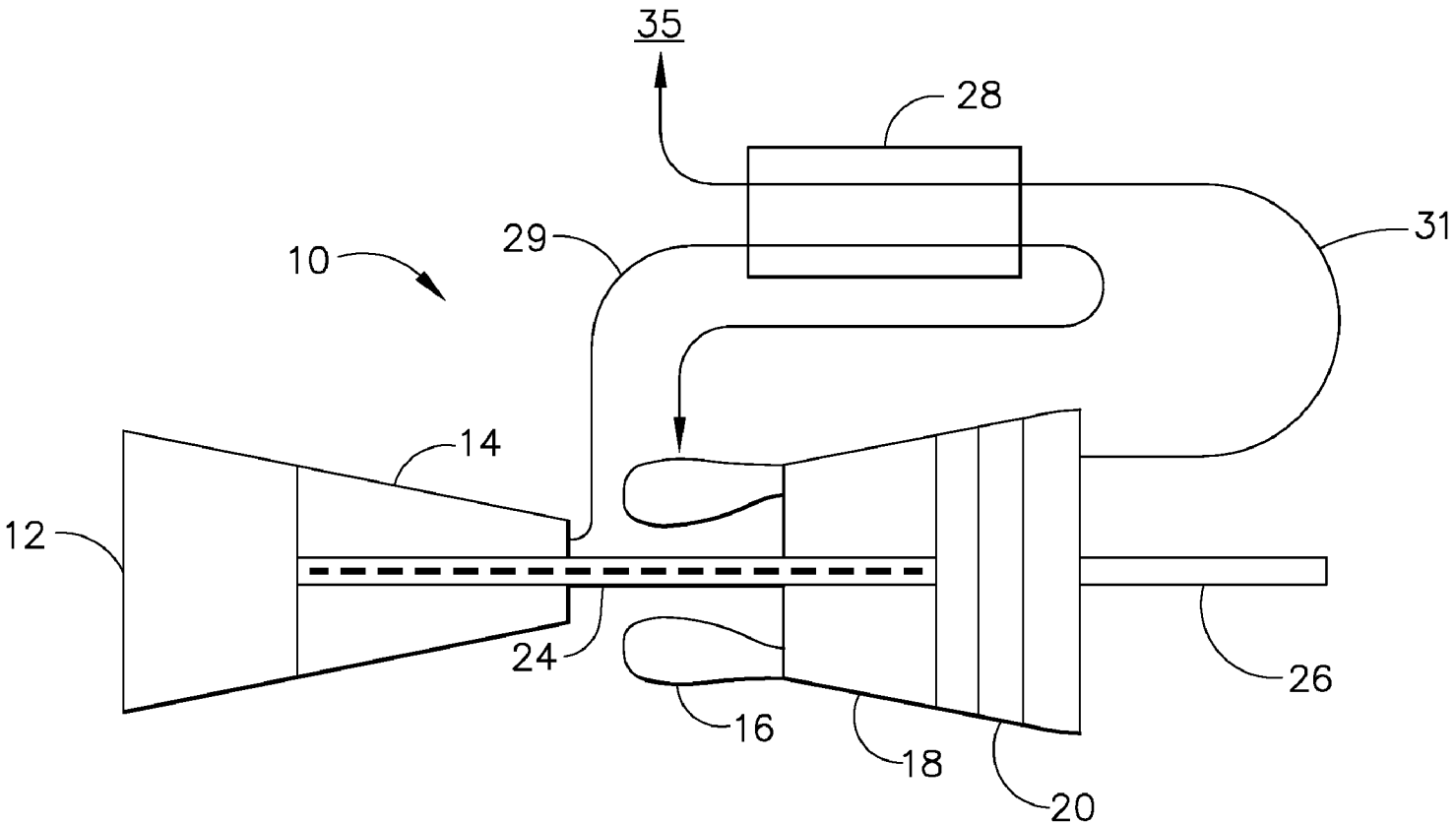
FIG. 1 is a schematic of a gas turbine engine.

FIG. 1 is a schematic illustration of a gas turbine engine 10 including a compressor 14, and a combustor 16. Engine 10 also includes a high pressure turbine 18 and a low pressure turbine 20. Compressor 14 and turbine 18 are coupled by a first shaft 24, and turbine 20 drives a second output shaft 26. Shaft 26 provides a rotary motive force to drive a driven machine, such as, but, not limited to a gearbox, a transmission, a generator, a fan, or a pump. Engine 10 also includes a recouperator 28 that has a first fluid path 29 coupled serially between compressor 14 and combustor 16, and a second fluid path 31 that is serially coupled between turbine 20 and ambient 35. In one embodiment, the gas turbine engine is an LV100 engine available from General Electric Company, Cincinnati, Ohio. In the exemplary embodiment, compressor 14 is coupled by a first shaft 24 to turbine 18, and powertrain and turbine 20 are coupled by a second shaft 26.

In operation, air flows through high pressure compressor 14. The highly compressed air is delivered to recouperator 28 where hot exhaust gases from turbine 20 transfer heat to the compressed air. The heated compressed air is delivered to combustor 16. Airflow from combustor 16 drives turbines 18 and 20 and passes through recouperator 28 before exiting gas turbine engine 10. In the exemplary embodiment, during operation, air flows through compressor 14, and the highly compressed recuperated air is delivered to combustor 16.

Figure 2:
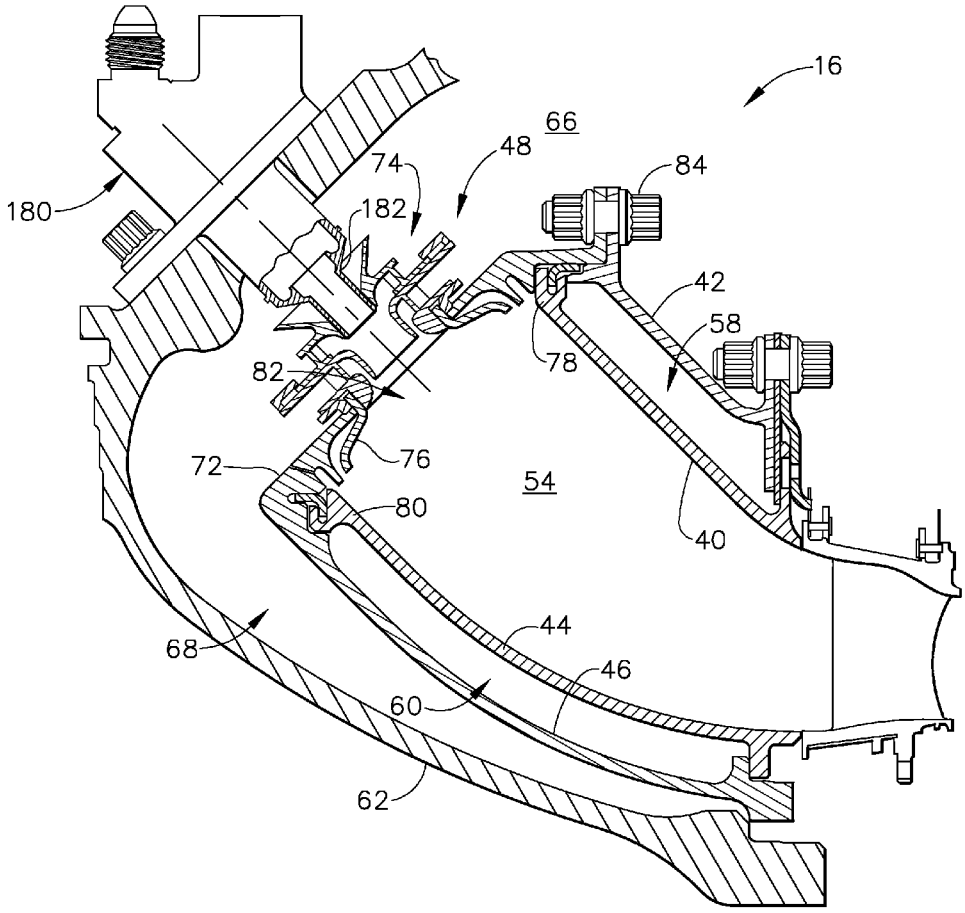
FIG. 2 is a cross-sectional illustration of a portion of a combustor used with the gas turbine engine shown in FIG. 1.
Figure 3:
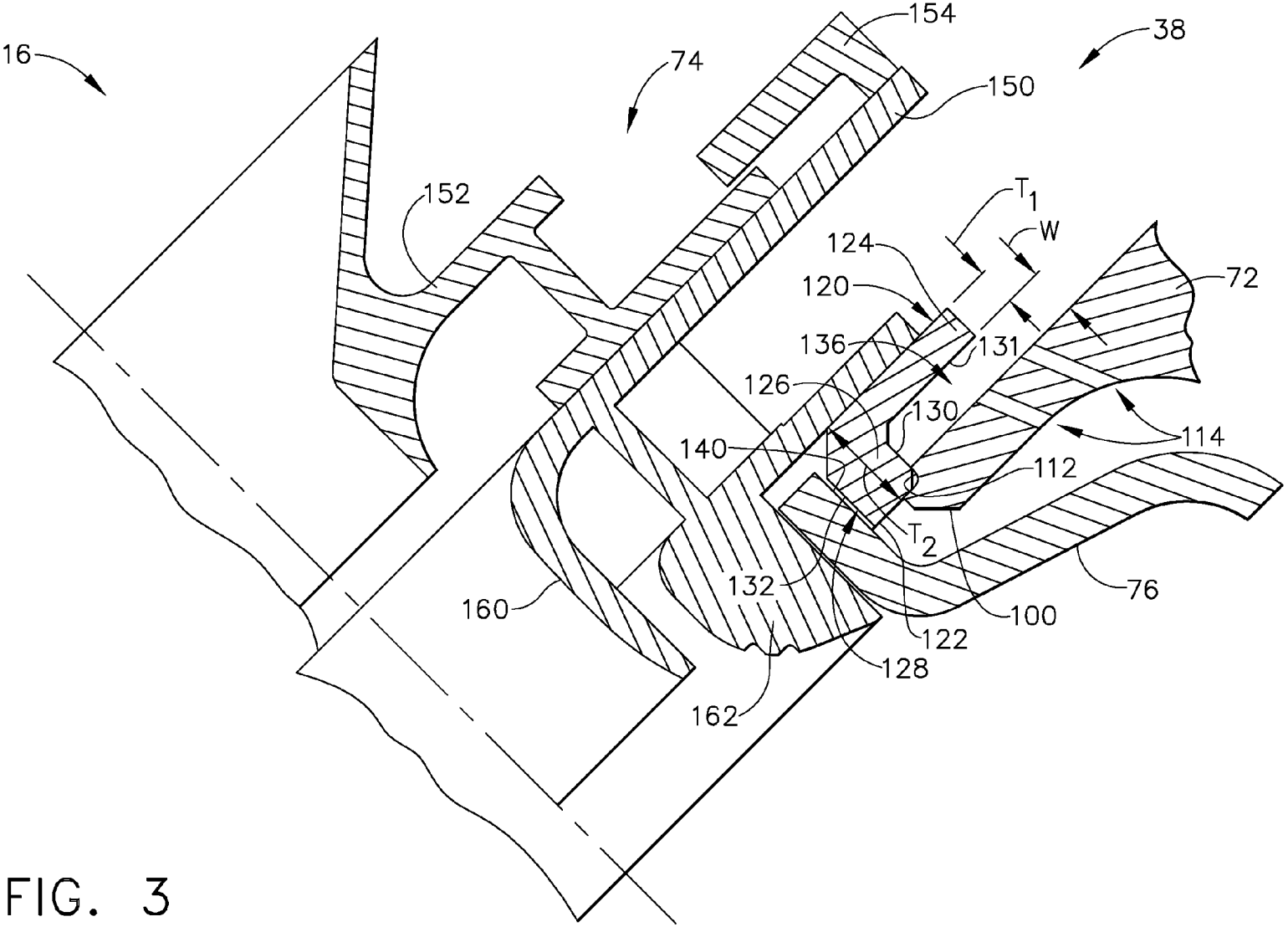
FIG. 3 is an enlarged view of a portion of a dome assembly used with the combustor shown in FIG. 2 and taken along area 3.
Figure 4:
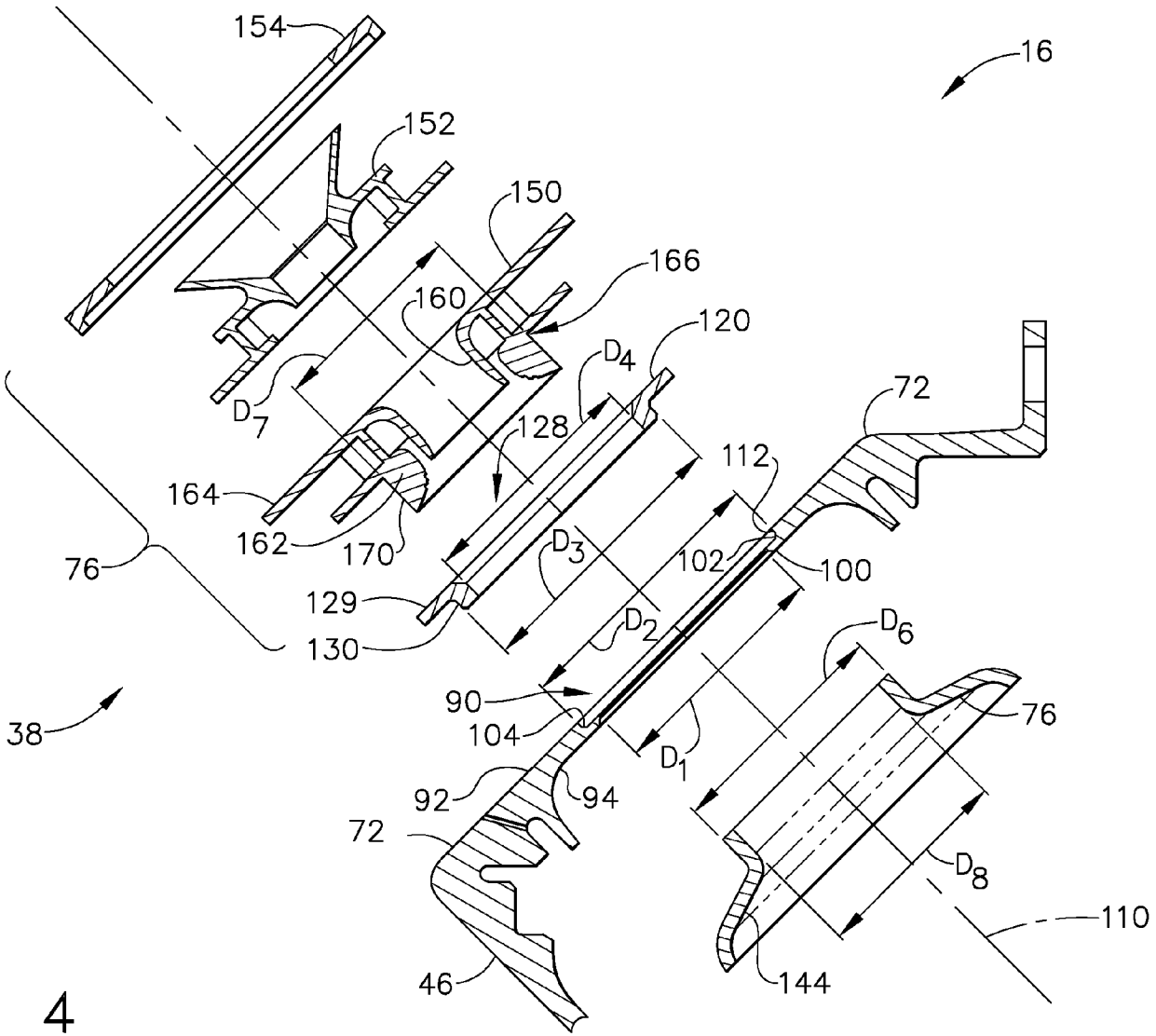
FIG. 4 is an enlarged exploded view of the dome assembly shown in FIG. 3.

FIG. 2 is a cross-sectional illustration of a portion of combustor 16. FIG. 3 is an enlarged view of a portion of a dome assembly 38 used with combustor 16 and FIG. 4 is an enlarged exploded view of dome assembly 38. Combustor 16 also includes an annular outer liner 40, an outer support 42, an annular inner liner 44, an inner support 46, and a dome 48 that extends between outer and inner liners 40 and 44, respectively.

Outer liner 40 and inner liner 44 extend downstream from dome 48 and define a combustion chamber 54 therebetween. Combustion chamber 54 is annular and is spaced radially between liners 40 and 44. Outer support 42 is coupled to outer liner 40 and extends downstream from dome 48. Moreover, outer support 42 is spaced radially outward from outer liner 40 such that an outer cooling passageway 58 is defined therebetween. Inner support 46 also is coupled to, and extends downstream from, dome 48. Inner support 46 is spaced radially inward from inner liner 44 such that an inner cooling passageway 60 is defined therebetween.

Outer support 42 and inner support 46 are spaced radially within a combustor casing 62. Combustor casing 62 is generally annular and extends around combustor 16. More specifically, outer support 42 and combustor casing 62 define an outer passageway 66 and inner support 46 and combustor casing 62 define an inner passageway 68. Outer and inner liners 40 and 44 extend to a turbine nozzle 69 that is downstream from liners 40 and 44.

Combustor dome assembly 38 includes an annular domeplate 72, a swirler assembly 74, and a baffle 76. Domeplate 72 is coupled to an upstream end 78 and 80 of outer and inner liners 40 and 44, respectively, such that domeplate 72 defines an upstream end 82 of combustion chamber 54. In the exemplary embodiment, inner support 46 is formed integrally with domeplate 72, and outer support 42 is coupled to domeplate 72 by at least one coupling member 84.

Domeplate 72 includes an opening 90 extending therethrough from an upstream side 92 to a downstream side 94 of domeplate 72. More specifically, within domeplate downstream side 94, opening 90 is defined by a chamfered edge 100 that circumscribes opening 90 and facilitates providing clearance for other combustor components, as described in more detail below. Within domeplate upstream side 92, opening 90 is defined by a counter-bored edge 102 that circumscribes opening 90 and defines a seat 104 within domeplate upstream side 92.

In the exemplary embodiment, opening 90 is substantially circular and is oriented substantially concentrically with respect to a combustor center longitudinal axis of symmetry 110 extending through combustor 16. Accordingly, opening 90 has a diameter $D_1$ measured across opening 90, and a diameter $D_2$ measured with respect to an outer edge 112 of seat 104. Seat diameter $D_2$ is larger than opening diameter $D_1$.

A plurality of cooling openings 114 extend through domeplate 72 between upstream and downstream sides 92 and 94, respectively. Openings 114 facilitate channeling cooling air through domeplate 72 to facilitate impingement cooling of baffle 76.

An annular sealplate 120 including a seated end 122, an overhang portion 124, and a body 126 extending therebetween is coupled to domeplate 72. In the exemplary embodiment, sealplate 120 is fabricated from Hast-X® and is welded to domeplate 72. Sealplate 120 is toroidal such that an opening 128 is defined therethrough. Sealplate seated end 122 has an outer diameter $D_3$ measured with respect to an outer edge 130 of seated end 122, and an inner diameter $D_4$ measured with respect to an inner wall 132 of sealplate 120 that defines opening 128. Seated end outer diameter $D_3$ is slightly smaller than domeplate seat diameter $D_2$. Accordingly, domeplate seat 104 is sized to receive sealplate seated end 122 therein such that sealing contact is facilitated between domeplate seat 104 and sealplate seated end 122 when sealplate 120 is coupled to domeplate 72. More specifically, when sealplate 120 is coupled to domeplate 72, sealplate 120 is substantially concentrically aligned with respect to domeplate 72 and axis of symmetry 110, such that sealplate body 126 is generally parallel to axis of symmetry 110.

In the exemplary embodiment, sealplate overhang portion 124 extends substantially perpendicularly outward from body 126. Overhang portion 124 has a thickness $T_1$ measured between an upstream side 129 of sealplate 120 and a downstream side 131 of overhang portion 124. Overhang portion thickness $T_1$ is thinner than a thickness $T_2$ of body 126 measured between upstream side 129 and seated end 122. Accordingly, when sealplate 120 is coupled to domeplate 72, a gap 136 is defined between sealplate overhang portion 124 and domeplate 72, or more specifically, between overhang portion downstream side 131 and domeplate upstream side 92. Domeplate cooling openings 114 are in flow communication with gap 136, such that cooling air directed into gap 136 during operation is channeled into domeplate cooling openings 114 to facilitate impingement cooling of baffle 76.

Baffle 76 is coupled to sealplate 120 and extends divergently downstream from domeplate 72 into combustion chamber 54. In the exemplary embodiment, baffle 76 is fabricated from Rene N5® and is coupled to sealplate 120 through a brazing process. More specifically, baffle 76 is coupled circumferentially against sealplate inner wall 132, and accordingly is coupled radially inward from sealplate 120 within domeplate opening 90. A radially outer surface 140 of baffle 76 defines an outer diameter $D_6$ of an upstream end 142 of baffle 76. Baffle outer diameter $D_6$ is slightly smaller than sealplate opening diameter $D_4$. In the exemplary embodiment, a radially inner surface or flowpath surface 144 of baffle 76 is coated with a layer of thermal barrier coating (TBC).

Swirler assembly 74 is coupled to sealplate 120 such that swirler assembly 74 is substantially concentrically aligned with respect to sealplate 120. Swirler assembly 74 includes a secondary swirler 150, a primary swirler 152, and a swirler retainer 154. Primary swirler 152 is retained against secondary swirler 152 by swirler retainer 154 such that primary swirler 152 is aligned substantially concentrically with respect to secondary swirler 150, but is free to move to accommodate thermal and mechanical stresses between fuel injector 182 and swirler assembly 74. More specifically, in the exemplary embodiment, swirler retainer 152 is welded to secondary swirler 150.

Secondary swirler 150 includes a substantially cylindrical body 162 and an attachment flange 164 that extends radially outwardly from body 162. More specifically, in the exemplary embodiment, attachment flange 164 extends substantially perpendicularly from body 162 such that an annular shoulder 166 is defined between a radially outer surface 170 of body 162 and flange 164. Body outer surface 170 defines an outer diameter $D_7$ for swirler 150 that is slightly smaller than an inner diameter $D_8$ defined by baffle flowpath surface 144. Accordingly, flange 164 is coupled to sealplate overhang portion 124 in substantial sealing contact. In the exemplary embodiment, flange 164 is welded to sealplate overhang portion 124.

Fuel is supplied to combustor 16 through a fuel injection assembly 180 that includes a plurality of circumferentially-spaced fuel nozzles 182 that extend into swirler assembly 74 into combustion chamber 54. More specifically, fuel injection assembly 180 is coupled to combustor 16 such that each fuel nozzle 182 is substantially concentrically aligned with respect to dome assembly 38, and such that nozzle 182 is configured to discharge downstream through swirler assembly 74 into combustion chamber 54. When fuel nozzle 182 is coupled to combustor 16, nozzle 182 circumferentially contacts primary swirler 152 to facilitate minimizing leakage to combustion chamber 54 between nozzle 82 and swirler assembly 74.

During assembly of combustor 16, initially domeplate 72 is machined from a near net shape forging. Opening 90 is then cut into domeplate 72 such that chamfered edge 100 is formed along domeplate downstream side 94. Edge 100 facilitates providing clearance for baffle 76 and sealplate welds. Domeplate upstream side 92 is then counter-bored to form edge 102 such that seat 104 circumscribes opening 90.

Sealplate seated end 122 is then inserted within domeplate seat 72 such that substantially circumferential sealing contact is created between sealplate 120 and domeplate 72 within seat 104. Accordingly, seat 104 aligns sealplate 120 with respect to domeplate 72 to facilitate minimizing leakage between domeplate 72 and sealplate 120. Moreover, because sealplate 120 is aligned with respect to domeplate 72 through seat 104, seat 104 also facilitates proper alignment between swirler assembly 74 and fuel injectors 182, and between baffle 76 and domeplate 72.

After sealplate 120 has been welded to domeplate 72, baffle 76 is then tack welded in position against sealplate 120. More specifically, tack welding baffle 76 to sealplate 120 facilitates ensuring sealplate 120 and baffle 76 form a predetermined dimensionally controlled assembly. Although, the tack welds provide secondary baffle retention, baffle 76 is primarily secured to sealplate 120 through a brazing process. Moreover, to facilitate the brazing process, during assembly of combustor 16, in the exemplary embodiment, baffle surface 140 is pre-sintered with braze tape adjacent baffle upstream end 142.

Swirler assembly 74 is then tack welded to sealplate 120. More specifically, swirler assembly 74 is tack welded to sealplate overhang portion 124 such that secondary swirler flange 164 is against sealplate overhang portion 124 in substantial sealing contact.

In the exemplary embodiment, a plurality of dome assemblies 38 formed as described above, are equally spaced around combustor domed end 48. Moreover, such assemblies 38 facilitate providing predetermined dimensional stack control of combustor dome assembly 38 to ensure combustor 16 satisfies pre-determined combustor performance requirements for pattern factor, profile factor, emissions control, starting, and useful life. Moreover, because a plurality of components are welded together, rather than coupled through an expensive brazing operation, dome assembly 38 facilitates reducing assembly costs compared to at least some other known combustor dome assemblies.

The above-described combustor dome assemblies provide a cost-effective and reliable means for operating a combustor. More specifically, each assembly includes a domeplate opening that is defined by a chamfered edge and an opposite counter-bored edge. The counter-bored edge facilitates aligning the sealplate relative to the domeplate such that leakage between the sealplate and domeplate is facilitated to be minimized. In addition, the counter-bored edge also facilitates aligning each swirler assembly relative to each fuel injector. As a result, a combustor assembly is provided which satisfies pre-determined combustor performance requirements while maintaining pre-determined operational requirements.

An exemplary embodiment of a combustor dome assembly is described above in detail. The combustor dome assembly components illustrated are not limited to the specific embodiments described herein, but rather, components of each dome assembly may be utilized independently and separately from other components described herein. For example, the dome assembly components described above may also be used in combination with other engine combustion systems.

While the invention has been described in terms of various specific embodiments, those skilled in the art will recognize that the invention can be practiced with modification within the spirit and scope of the claims.

What is claimed is:

1. A method for assembling a combustor for a gas turbine engine, the combustor including a swirler assembly, said method comprising:

machining material to form a domeplate, wherein said machining further comprises forming an opening extending through the domeplate such that the opening is defined along a first side of the domeplate by a chamfered edge and counter-boring an edge defining the opening along an opposite second side of the domeplate;

positioning a sealplate including an overhanging portion against the domeplate;

securing the sealplate in position relative to the domeplate with a welding process; and welding the swirler assembly to the domeplate.

2. A method in accordance with claim 1 further comprising coupling a swirler to the combustor such that at least a portion of the swirler extends through the domeplate opening.

3. A method in accordance with claim 1 wherein securing the sealplate in position relative to the domeplate further comprises securing the sealplate in position to facilitate aligning the swirler relative to the domeplate.

4. A method in accordance with claim 1 wherein securing the sealplate in position relative to the domeplate further comprises securing the sealplate in position such that a gap is defined between the sealplate overhang portion and the domeplate.

5. A method in accordance with claim 1 further comprising coupling a baffle to the sealplate using a brazing process.

6. A method for assembling a gas turbine engine combustor, said method comprising:

coupling a sealplate including an overhanging portion against a domeplate with a welding process such that an annular gap is defined between the sealplate overhanging portion and the domeplate;

welding a combustor swirler assembly to the domeplate;

inserting at least one injector into the combustor such that the at least one injector is coupled to the domeplate, said inserting further comprising forming an opening in the domeplate that extends from an upstream side of the dome plate to a downstream side of the domeplate and chamfering an edge that circumscribes the opening such that edge defines the opening within the domeplate; and inserting the at least one injector through the opening.

7. A method in accordance with claim 6 wherein said forming an opening in the domeplate further comprises chamfering an edge that circumscribes the opening such that edge defines the opening within the domeplate.

8. A method in accordance with claim 6 wherein said forming an opening in the domeplate further comprises forming the opening with a counter-bored edge that facilitates aligning the swirler assembly with respect to the domeplate.

9. A method in accordance with claim 6 further comprising coupling a baffle to the sealplate such that the baffle extends downstream from the domeplate.

10. A method in accordance with claim 9 wherein said coupling a baffle to the sealplate further comprises welding the baffle to the seal plate.

11. A method in accordance with claim 6 further comprising:

coupling at least a secondary swirler to the sealplate; and coupling a primary swirler to the secondary swirler.

* * * * *